US007744432B2

(12) United States Patent
Son

(10) Patent No.: US 7,744,432 B2
(45) Date of Patent: Jun. 29, 2010

(54) SQUIB CONNECTOR CONNECTING STRUCTURE OF AIRBAG INFLATOR

(75) Inventor: Sungwon Son, Incheon (KR)

(73) Assignee: Hyundai Motor Company, Seoul (KR)

( * ) Notice: Subject to any disclaimer, the term of this patent is extended or adjusted under 35 U.S.C. 154(b) by 94 days.

(21) Appl. No.: 12/323,387

(22) Filed: Nov. 25, 2008

(65) Prior Publication Data

US 2009/0152837 A1 Jun. 18, 2009

(30) Foreign Application Priority Data

Dec. 13, 2007 (KR) ..... 10-2007-0130029

(51) Int. Cl.
*H01R 13/415* (2006.01)

(52) U.S. Cl. ..... 439/743; 439/352

(58) Field of Classification Search ..... 439/743, 439/352

See application file for complete search history.

(56) References Cited

U.S. PATENT DOCUMENTS 6,676,452 B2 1/2004 Bolen et al.
2007/0266885 A1* 11/2007 Takimoto ..... 102/530

FOREIGN PATENT DOCUMENTS

| | | |
|---|---|---|
| JP | 2004 171843 | 6/2004 |
| JP | 2005 255061 | 9/2005 |
| KR | 2002 0018080 | 3/2002 |

* cited by examiner

*Primary Examiner*—Tho D Ta
(74) *Attorney, Agent, or Firm*—Morgan, Lewis & Bockius LLP

(57) ABSTRACT

A squib connector connecting structure of an airbag inflator comprises a shunt bar connector and a retainer sequentially inserted into an insertion hole of an inflator, and a squib connector inserted into retainer. Further, a guide groove is formed at insertion hole of inflator and a body of squib connector is fully fitted into guide groove.

10 Claims, 5 Drawing Sheets

SQUIB CONNECTOR CONNECTING STRUCTURE OF AIRBAG INFLATOR

CROSS-REFERENCE TO RELATED APPLICATION

The present application claims priority to Korean Application Number 10-2007-0130029 filed Dec. 13, 2007, the entire contents of which application is incorporated herein for all purposes by this reference.

BACKGROUND OF THE INVENTION

1. Field of the Invention

The present invention relates to an airbag system of a vehicle, and more particularly, to a squib connector connecting structure of an inflator.

2. Description of Related Art

An airbag is used to protect a passenger from an impact during a vehicle accident. In recent years, various airbags, such as airbags for passengers seated on the rear seats and airbags against side collision, have been provided as well as airbags for a driver's seat and a passenger seat.

An airbag (exactly, an airbag cushion) is folded so as to be easily deployed, and an inlet of the airbag is connected to a gas outlet of the inflator. If an airbag control unit receives a collision signal stronger than a predetermined intensity from a collision detecting sensor and generates an inflator operating signal, the inflator operates.

Meanwhile, a squib connector, which is connected to main wiring of an airbag, is connected to the inflator. Squib connector 10 is shown in FIG. 1A.

The inflator is provided with a retainer 20 shown in FIG. 1B so as to be connected to squib connector 10.

As shown in FIGS. 2 and 3, retainer 20 is provided with shunt terminals 21, and shunt bars 31 of a shunt bar connector 30 provided below the retainer 20 are inserted into a central portion of retainer 20.

Before the connection of squib connector 10, shunt bar 31 and shunt terminal 21 come in contact with each other, thereby forming a closed-circuit state. When squib connector 10 is inserted into retainer 20 and a push slider 11 is pushed, shunt terminal 21 is separated from shunt bar 31 and the state is converted into an open-circuit state. In this case, a squib connector terminal 12 is connected to shunt terminal 31, so that an airbag deployment signal can be sent.

Meanwhile, there are problems in that squib connector 10 can be broken or separated due to operator's mistakes or the interference with peripheral components when being connected to inflator 40. Since most components of an airbag cannot be recycled, the loss of cost is very large due to this.

Since squib connector 10 protrudes from the surface of inflator 40 to the outside as shown in FIG. 3, the above-mentioned problems of the breakage and separation of the connector more frequently occur.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a squib connector connecting structure of an airbag inflator that can prevent the abnormal assembly of a squib connector and the breakage or separation caused by the interference with peripheral components when the squib connector is assembled.

According to an aspect of the present invention, the squib connector connecting assembly of an airbag inflator may include an insertion hole formed at upper end of the airbag inflator, a shunt bar connector and a retainer having a through-hole at lower surface thereof, wherein the shunt bar connector coupled to the retainer through the through-hole are inserted into the insertion hole of the airbag inflator, a guide groove formed at the insertion hole of the airbag inflator, and/or a squib connector, one end portion of which is fully fitted into the guide groove.

A hook may be formed on side surface of the one end portion of the squib connector and a locking groove may be formed on an inner peripheral surface of the insertion hole of the airbag inflator so that the hook of the squib connector is caught by the locking groove.

The shunt bar connector may be elastically supported by an elastic member to bias the shunt bar connector toward the retainer. The elastic member may be a spring provided below the shunt bar connector in the airbag inflator. Upper and lower spring seats may be provided at upper and lower ends of the spring, respectively, wherein the upper spring seat is disposed under the shunt bar connector.

A protrusion may be formed at upper end of the shunt bar connecter and pressed into the through-hole of the retainer by elastic force of the elastic member when the squib connector is locked to the airbag inflator.

Thickness of the guide groove may be equal to or larger than thickness of the one end portion of the squib connector.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
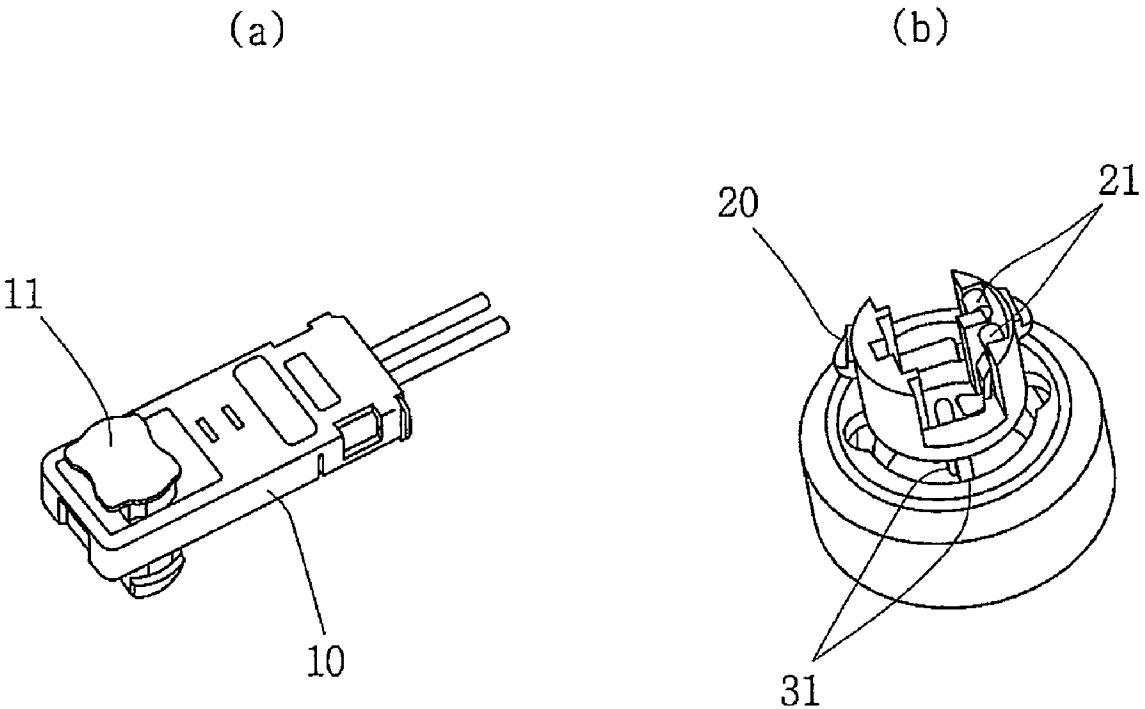
FIG. 1(*a*) and 1(*b*) are perspective views of an exemplary squib connector and a retainer.
Figure 2:
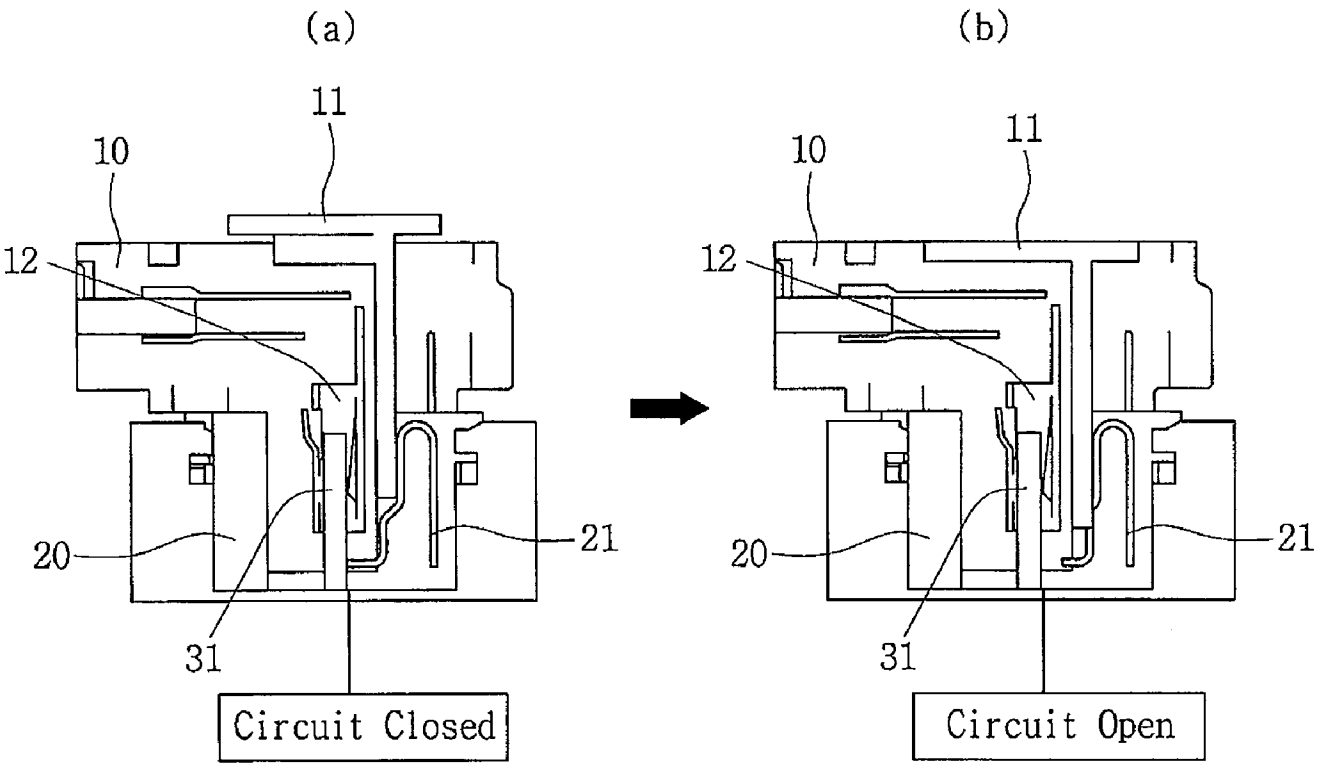
FIG. 2(*a*) and 2(*b*) are cross-sectional views of an exemplary squib connector connecting structure, and show that internal terminals are connected to each other by the connection of the squib connector.
Figure 3:
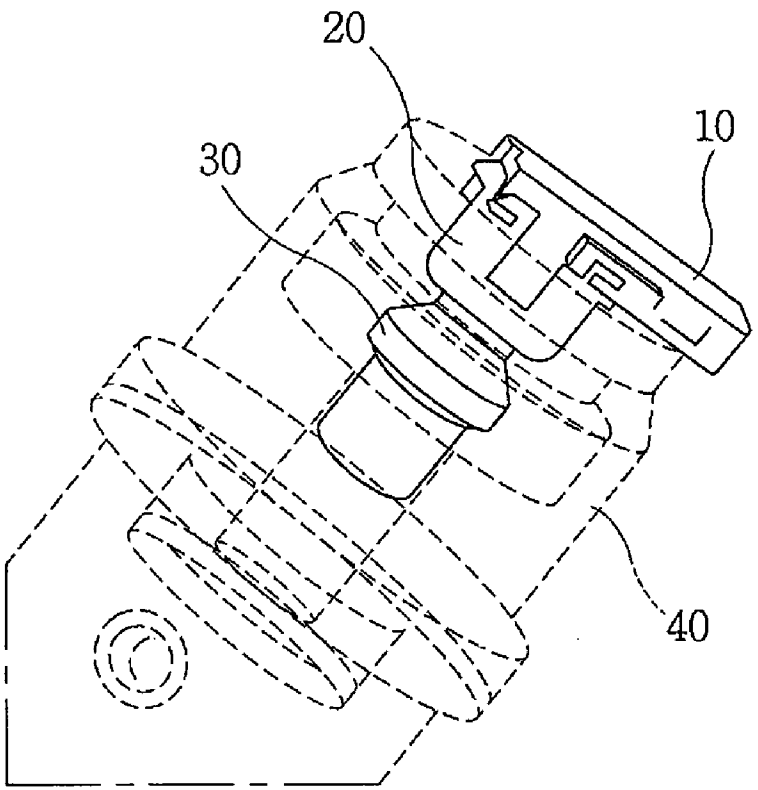
FIG. 3 is a perspective view of an exemplary squib connector connecting structure.
Figure 4:
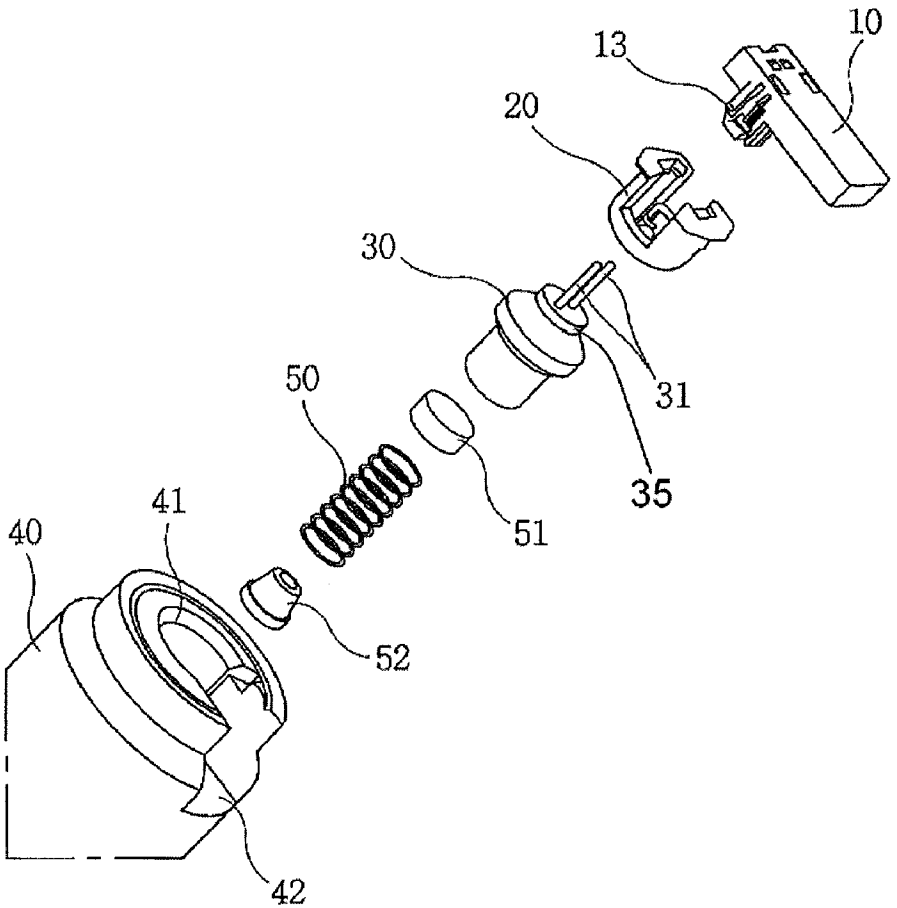
FIG. 4 is an exploded perspective view of an exemplary squib connector connecting structure according to the present invention.
Figure 5:
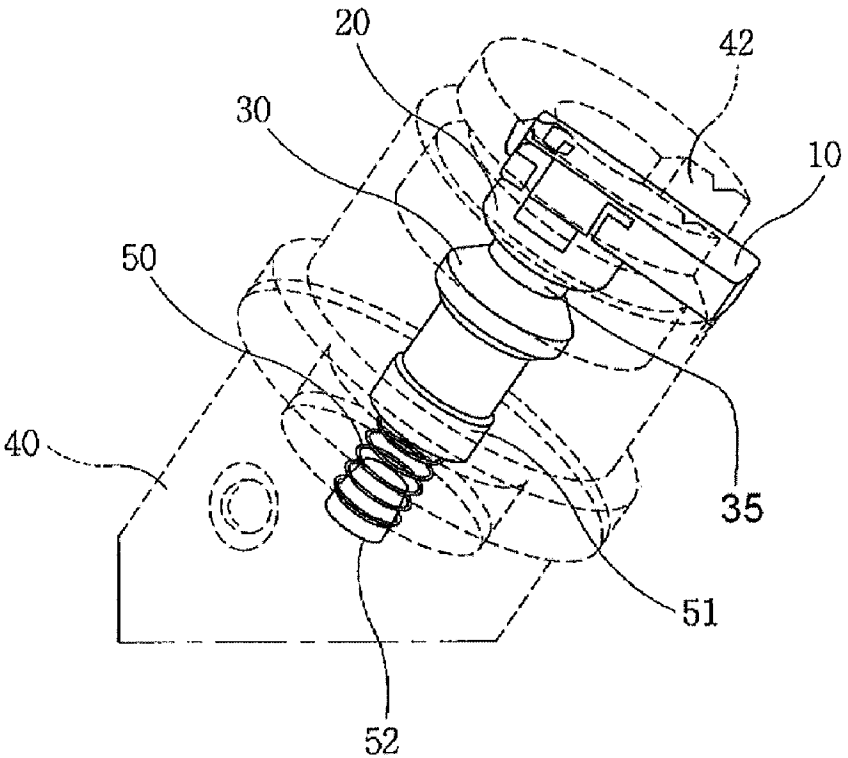
FIG. 5 is a view showing the assembled squib connector connecting structure according to the present invention.

FIG. 4 is an exploded perspective view of a squib connector connecting structure of an airbag inflator according to various embodiments of the present invention, and FIG. 5 is a view showing the assembled squib connector connecting structure.

As shown in the drawings, a circular insertion hole 41 is formed at the center of a portion of an inflator 40 to which a squib connector 10 is connected as explained hereinafter.

A shunt bar connector 30 including a pair of shunt bars 31, and a retainer 20 including a pair of shunt terminals are inserted into insertion hole 41.

A cylindrical protrusion 35 formed at an upper end of shunt bar connector 30 is pressed into a through-hole formed at a lower surface of retainer 20. In this case, shunt bars 31 are inserted into retainer 20 and connected to the shunt terminals, so that a closed circuit is formed.

Meanwhile, insertion hole 41 is formed to extend toward the lower side of shunt bar connector 30, and a spring 50 is provided in the insertion hole 41.

Spring 50 includes a lower spring seat 52 that is provided between the bottom of insertion hole 41 and the spring, and an upper spring seat 51 that is provided between shunt bar connector 30 and the spring.

The upper and lower spring seats 51 and 52 ensure the stability in mounting spring 50, and allow an elastic supporting force of spring 50 to be stably applied to shunt bar connector 30.

Meanwhile, a guide groove 42, which has the same width (including assembly clearance) as a body of squib connector 10, is formed at the upper end of inflator 40, that is, at a portion of insertion hole 41.

Accordingly, when the terminals of squib connector 10 are inserted into retainer 20, the body of squib connector 10 is fitted into guide groove 42.

In this case, while compressing spring 50, retainer 20 and shunt bar connector 30 are inserted into insertion hole 41. Since the retainer and the shunt bar connector are elastically supported by spring 50, the connection of shunt bar connector 30 and retainer 20 is firmly maintained.

Further, hooks 13 protrude from both side surfaces of squib connector 10, and locking grooves are formed on the inner peripheral surface of insertion hole 41 of inflator 40 so as to correspond to hooks 13 when squib connector 10 is fitted into guide groove 42 as described above.

Therefore, hooks 13 are caught by the locking grooves, so that squib connector 10 is completely connected.

In the assembled state of FIG. 5, squib connector 10 is completely inserted into insertion hole 41 and guide groove 42. Therefore, the squib connector does not protrude from inflator 40 to the outside.

As a result, since interference with peripheral components does not occur, there is no concern about breakage caused by an external force.

Further, unless the rear portion of the body of the squib connector 30 is fitted into guide groove 42 when the terminals of squib connector 10 are inserted into retainer 20, it is not possible to assemble the squib connector. For this reason, the squib connector should be assembled in position so as to correspond to guide groove 42, thereby preventing the squib connector from being abnormally assembled. As a result, assembly efficiency is improved, and the damage of components caused by the abnormal assembly does not occur.

As described above, according to various embodiments of the present invention, it is possible to obtain the following advantages. That is, the abnormal assembly of squib connector 10 does not occur and the breakage caused by the interference with peripheral components does not occur. For this reason, the loss of cost required for the breakage of components is significantly reduced. Further, since the squib connector is firmly connected, the separation of the squib connector caused by an external force does not occur after assembly.

For convenience in explanation and accurate definition in the appended claims, the terms "upper" or "lower", "rear", "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A squib connector connecting assembly of an airbag inflator, the assembly comprising:

an insertion hole formed at upper end of the airbag inflator;

a shunt bar connector and a retainer having a through-hole at lower surface thereof, wherein the shunt bar connector coupled to the retainer through the through-hole is inserted into the insertion hole of the airbag inflator;

a guide groove formed at the insertion hole of the airbag inflator; and a squib connector, one end portion of which is fully fitted into the guide groove, wherein the squib connector does not protrude outside from the airbag inflator.

2. The squib connector connecting assembly as defined in claim 1, wherein a hook is formed on side surface of the one end portion of the squib connector and a locking groove is formed on an inner peripheral surface of the insertion hole of the airbag inflator so that the hook of the squib connector is caught by the locking groove.

3. The squib connector connecting assembly as defined in claim 1, wherein the shunt bar connector is elastically supported by an elastic member to bias the shunt bar connector toward the retainer.

4. The squib connector connecting assembly as defined in claim 3, wherein the elastic member is a spring provided below the shunt bar connector in the airbag inflator.

5. The squib connector connecting assembly as defined in claim 4, wherein upper and lower spring seats are provided at upper and lower ends of the spring, respectively, wherein the upper spring seat is disposed under the shunt bar connector.

6. The squib connector connecting assembly as defined in claim 3, wherein a protrusion is formed at upper end of the shunt bar connecter and pressed into the through-hole of the retainer by elastic force of the elastic member when the squib connector is locked to the airbag inflator.

7. The squib connector connecting assembly as defined in claim 1, wherein thickness of the guide groove is equal to or larger than thickness of the one end portion of the squib connector.

8. An airbag inflator comprising the squib connector connecting assembly as defined in claim 1.

9. An airbag assembly comprising the airbag inflator as defined in claim 8.

10. A passenger vehicle comprising the airbag assembly as defined in claim 9.

* * * * *